United States Patent [19]

Pickens et al.

[11] 3,978,813

[45] Sept. 7, 1976

[54] PROPELLER-DRIVEN HYDROPHONE ARRAY TENSIONING DEVICE

[75] Inventors: George O. Pickens, San Diego; Charles E. Hansen, Chula Vista, both of Calif.

[73] Assignee: The United States of America as represented by the Secretary of the Navy, Washington, D.C.

[22] Filed: Jan. 9, 1976

[21] Appl. No.: 647,686

[52] U.S. Cl. ..... 115/6; 114/235 B

[51] Int. Cl.[2] ..... B63B 21/56

[58] Field of Search ..... 114/235 B, 209; 115/6, 115/20; 340/3 T, 8 FT; 416/129

[56] References Cited

UNITED STATES PATENTS

| | | | |
|---|---|---|---|
| 1,487,138 | 3/1924 | Atwood | 340/8 FT |
| 2,974,627 | 3/1961 | Whipple, Jr. | 114/235 B |
| 3,872,819 | 3/1975 | Pickens | 115/4 |

*Primary Examiner*—Trygve M. Blix
*Assistant Examiner*—Jesus D. Sotelo
*Attorney, Agent, or Firm*—Richard S. Sciascia; Ervin F. Johnston; William T. Skeer

[57] ABSTRACT

A tensioning device for submarine oceanographic structures includes a surface float having a pendent line suspended therebeneath and a vertical rod support attached to the distal end of the pendent line. An electrical motor attached to the lower end of the support provides ballast to hold the rod in a substantially vertical position and also provides mechanical motive power to turn two coaxially mounted hydrodynamic screws. These screws are attached to the support so as to provide a propulsive force for the support and surface float system. A hitch employing standard marine hardware connects the tensioning system to an underwater structure such that this propulsive force is used to tension the structure. Power for the electrical motor is provided by a source of electrical power housed in a small surface vessel and effectively connected to the surface float and pendent line.

16 Claims, 1 Drawing Figure

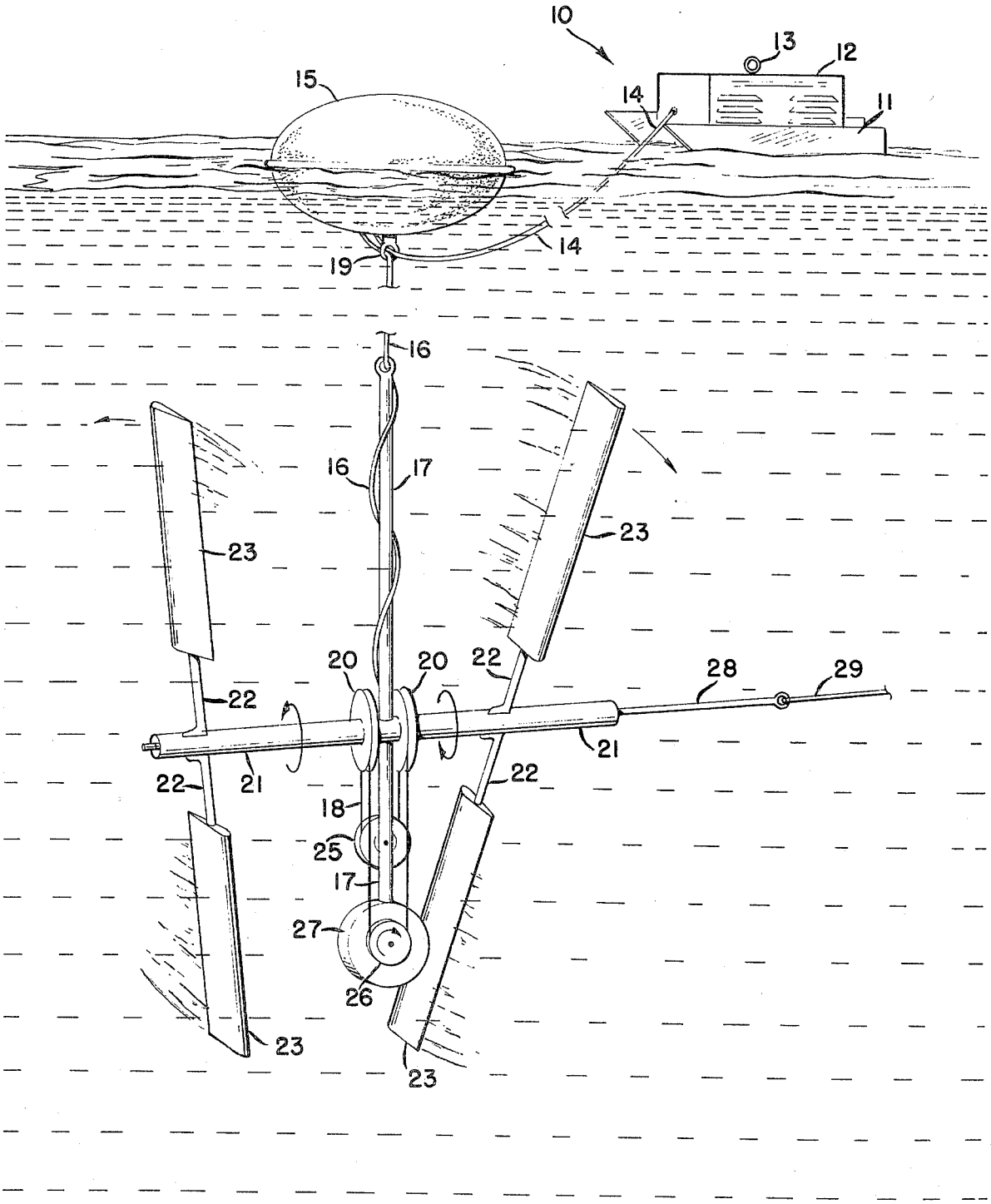
10
13
12
15
14
11
14
19
16
16
17
23
23
20
20
22
28
29
22
21
21
22
22
18
25
17
27
26
23
23

PROPELLER-DRIVEN HYDROPHONE ARRAY TENSIONING DEVICE

STATEMENT OF GOVERNMENT INTEREST

The invention described herein may be manufactured and used by or for the Government of the United States of America for governmental purposes without the payment of any royalties thereon or therefor.

FIELD OF THE INVENTION

This invention pertains to the field of naval architecture. In greater particularly, the invention pertains to a marine propulsion plant useful in the oceanographic sciences. In still greater particularity, an electric motor driven floating system provides a transitory force which is used to tension and position underwater structures such as a hydrophone array.

DESCRIPTION OF THE PRIOR ART

In general, underwater horizontal hydrophone arrays are held in position be means of anchors and buoys or, alternatively, by means of surface towing ships which are attached to the hydrophone array by means of cables. Additionally, prior art arrangements have employed wave actuated propulsion means to tension the arrays.

In instances where the hydrophone array is positioned by means of anchors, underwater cables, and cooperating buoys, the various anchor lines are slanted and connected to the array such that horizontal components are generated by the tension in the anchor line and the upwards pull of the cooperating buoys. In such instances, depth is regulated by using fixed length cables to connect the cooperating buoy to the underwater arrays. These systems while satisfactory in some applications, require operational water depths shallow enough to position the anchors on the bottom so as to maintain a properly slanted anchor line. These conditions are not always available and, furthermore, great expenses are encountered in the transportation and deployment of these oceanographic arrays. These expenses and the length of time necessary to establish such an array preclude the economic use of this anchoring system for short time periods and limit its use to relatively shallow waters.

Similarly the use of surface towing ships to stretch and position an array requires the expenditure of considerable manpower and operational equipment. These requirements limit the maintenance of the array in a remote section of the ocean and effectively prohibits either long term or covert placement of these arrays.

Wave actuated horizontal array stretchers such as shown in U.S. Pat. No. 3,872,819 granted on Mar. 25, 1975 to George O. Pickens for "Wave-Actuated Horizontal Array Stretcher", while satisfactory for their intended purposes, suffer from being repositioned by oceanographic currents and underwater turbulences such that the positioning of the arrays for extended periods of time requires replacing and repositioning the various array stretching motor systems.

Therefore, a persistent need in the oceanographic arts for a method and apparatus of placement of horizontally disposed electroacoustic arrays which may be maintained in place for a relatively long period without the use of a plurality of station keeping vessels or ocean floor anchored arrays has long been felt in the oceanographic instrumentation arts.

SUMMARY OF THE INVENTION

This invention comprises a vertically extending rod-like support which carries an electric motor drive on the lower end thereof. The support is tethered to a surface buoy by means of a pendent line which carries electrical power to the electric motor. A cross member mounted on the vertical support provides journaling for a pair of counter-rotating marine screws which are driven by the electric motor by means of a belt and a pulley drive system. Connection to the hydrophone array or other underwater load is made by means of a suitable hitch which, conveniently, may be attached to the cross member support.

STATEMENT OF THE OBJECTS OF INVENTION

The primary purpose of this invention is to provide a propulsion system for marine environments.

Another object of the present invention is to provide a tensioning system suitable for stretching and positioning underwater electroacoustic arrays.

Another object of the present invention is to provide an easily deployed drive system to provide propulsive forces at great ocean depths.

Another object of this invention is to provide an electrically driven underwater tensioning system.

Yet another object of this present invention is to provide a marine propulsion unit which is supplied by a surface source of electrical energy.

Yet a further object of this invention is to provide a submarine tensioning force to tension and position an electroacoustic array in the ocean environment.

These and other objects of the invention will become more readily apparent from the ensuing specification when taken together with the drawings.

BRIEF DESCRIPTION OF THE DRAWING

The FIGURE is a perspective view of the system of the invention showing its component parts in an operative environment.

DESCRIPTION OF THE PREFERRED EMBODIMENTS

Referring to the FIGURE, a source of electrical power, indicated generally at 10, includes a catamaran surface vessel 11 which supports a source of electrical power such as a motor-generator 12. Motor-generator 12 may be of any suitable commercially available type, however, a propane-fueled unit mounted in a splash proof cover has proven very satisfactory in developmental models and may be employed to good effect in the system of the invention. Motor generator 12 is shock mounted and the exhaust is muffled in order to suppress undesired acoustic noise radiation into the ocean. A lifting bail 13 is mounted on the upper surface of the source of electrical power 10 and may be used to hoist small catamaran vessel 11 together with the motor generator 12 aboard a surface vessel for periodic servicing when it is desired to keep the system of the invention on station for longer periods of time.

An electrical conductor 14 is supported by catamaran vessel 11 and it takes the electrical output of motor generator 12 to an oceanographic surface float 15. The surface float 15 may be a conventional oceanographic float and may, if desired, contain signal processing electronics which would be connected to the tensioned hydrophone array by means of conventional signal transmission links, not shown. A pendent line 16 extends downwardly from float 15 and includes an electrical power conductor so as to transmit the power generated by motor-generator 12 to the tensioning system for utilization thereby in a fashion to be described. Pendent line 16 and electrical conductor 14 are supported by the surface float 15 and are attached thereto by means of a fixed attachment point 19 extending in the water therebelow.

At the distal end of pendent line 16 a vertical support 17 extends downwardly to terminate in an electric motor 27. In order to facilitate electrical connection with motor 27 and to prevent fouling the drive system, to be described, line 16 may conveniently be faired within support 17, if desired. Mechanical drive is taken from motor 27 by means of an external pulley 26 which rotates in the direction indicated by the arrow thereon.

A cross member 28 is attached to support 17 and has two hubs 21 journaled thereon for rotation thereabout. Arms 22 extend radially outwardly from hubs 21 and support a plurality of hydrofoils 23 which, upon rotation of hubs 21, are carried therewith by arms 22 such as to provide hydrodynamic screws for the assemblage. Hubs 21 each have a drive pulley 20 affixed to the inboard end thereof which are connected to a drive belt 18 which is threaded about motor pulley 26 and an idler pulley 25 which is rotably attached to support arm 17 in a vertically displaced position above motor 27.

Thus, when motor 27 rotates pulley 26 in a direction indicated, the belt drive transmits the motion to rotate hubs 21 in the directions indicated by the arrows encircling these members. Because pulleys 20 are located on the opposite sides of the drive tensioned belt, the forward pair of hydrofoils 23 are caused to rotate in an opposite direction from the aft pair.

The rotation of the hydrofoils 23 cooperate to provide a counter rotating marine screw which tends to provide a propulsive force moving the entire system. This propulsive force is coupled via hitch 28 to a line 29 which, in turn, provides the tensioning force for the marine structure.

When the marine structure being tensioned is a hydrophone array, line 29 may be of considerable extent to isolate any acoustic disturbence created by the propulsion screws from interfering with the electroacoustic conversion of the oceanographic signals. For example, line 29 may be approximately 400 meters long and made of a light weight synthetic yarn marine fiber. Of course, other methods of attaching the tensioned load to the tensioning system may be readily substituted for that shown and, in general, persons proficient in the marine engineering arts are free to choose between existing systems if the attendant trade-offs which are well understood in such design choices.

Similarly, other substitutions and alterations of the system of the invention will suggest themselves and may, for example, include mounting the motor generator 12 in a semi-submerged vessel which exhaust to the atmosphere by means of a snorkel and including electronic instrumentation packages within float 15 to process signals received from the tensioned hydrophone array or other oceanographic pay load to which tensioning force is applied.

The foregoing description taken together with the appended claims constitute a disclosure such as to enable a person skilled in the oceanographic and marine engineering arts and having the benefit of the teachings contained therein to make and use the invention. Further, the structure herein described meets the objects of invention, and generally constitutes a meritorious advance in the art unobvious to such a worker not having the benefit of these teachings.

Obviously, many modifications and variations of the present invention are possible in the light of the above teachings, and, it is therefore understood that within the scope of the disclosed inventive concept, the invention may be practiced otherwise than specifically described.

What is claimed is:

1. A tensioning device for applying a tensional force to a submarine structure comprising:

a surface float;

a pendent line attached to said float and extending downwardly therefrom;

an electrical conductor carried by said pendent line for transmission of electrical energy therealong;

a support attached at one end thereof to said pendent line at the lower, distal end thereof;

an electrical motor mechanically attached to said support means at the end opposite said one end to which said pendent line is attached for providing hydrodynamic stability;

a cross member attached to said support forming a cruciform support therewith;

hydrodynamic screw means rotably mounted on said cross member for providing translatory force on the tensioning device;

power transmission means effectively joining said electrical motor and said hydrodynamic screw means for the transmission of mechanical energy therebetween; and hitch means effectively connected to said support means for attachment to the submarine structure, whereby the translatory force applied to the tensioning device may be effective to provide a tensioning force to the submarine structure.

2. A tensioning device according to claim 1 further comprising:

a source of electrical power;

surface vessel means supporting said source of electrical power on the surface of the body of fluid in which said submarine structure is submerged; and an electrical power conductor electrically connected to said source of electrical power at one end and effectively electrically connected to said electrical conductor carried by said pendent line and mechanically supported by said surface vessel and said surface float.

3. A tensioning device according to claim 2 wherein said source of electrical power includes a motor driven generator.

4. A tensioning device according to claim 3 wherein said support includes a vertically extending rod.

5. A tensioning device according to claim 4 in which said hydrodynamic screw means includes at least one two blade screw.

6. A tensioning device according to claim 5 in which said hydrodynamic screw means includes a pair of counter-rotating screws coaxially mounted on said cross member.

7. A tensioning device according to claim 6 in which said power transmission means includes a flexible belt drive.

8. A tensioning device according to claim 7 in which said power transmission means includes an idler pulley.

9. A tensioning device according to claim 8 in which said power transmission means includes belt drive pulleys attached to each of said counter-rotating screws.

10. A tensioning device according to claim 1 comprising a source of electrical power which includes a motor driven generator.

11. A tensioning device according to claim 1 wherein said support includes a vertically extending rod.

12. A tensioning device according to claim 1 in which said hydrodynamic screw means includes at least one two blade screw.

13. A tensioning device according to claim 12 in which said hydrodynamic screw means includes a pair of counter-rotating screws coaxially mounted on said cross member.

14. A tensioning device according to claim 1 in which said power transmission means includes a flexible belt drive.

15. A tensioning device according to claim 14 in which said power transmission means includes an idler pulley.

16. A tensioning device according to claim 15 in which said power transmission means includes belt drive pulleys attached to each of said counter-rotating screws.

* * * * *